US010639925B2

(12) United States Patent
Fuhse

(10) Patent No.: US 10,639,925 B2
(45) Date of Patent: May 5, 2020

(54) VISUALLY VARIABLE SECURITY ELEMENT

(71) Applicant: GIESECKE+DEVRIENT CURRENCY TECHNOLOGY GMBH, München (DE)

(72) Inventor: Christian Fuhse, Otterfing (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/572,531

(22) PCT Filed: May 4, 2016

(86) PCT No.: PCT/EP2016/000734
§ 371 (c)(1),
(2) Date: Nov. 8, 2017

(87) PCT Pub. No.: WO2016/180522
PCT Pub. Date: Nov. 17, 2016

(65) Prior Publication Data

US 2018/0117947 A1 May 3, 2018

(30) Foreign Application Priority Data

May 8, 2015 (DE) ..... 10 2015 005 969

(51) Int. Cl.
*B42D 25/324* (2014.01)
*B42D 25/328* (2014.01)
(Continued)

(52) U.S. Cl.
CPC ..... *B42D 25/324* (2014.10); *B42D 25/29* (2014.10); *B42D 25/328* (2014.10);
(Continued)

(58) Field of Classification Search
CPC ..... B42D 25/324; B42D 25/328
See application file for complete search history.

(56) References Cited

U.S. PATENT DOCUMENTS 7,604,855 B2 * 10/2009 Raksha ..... B42D 25/29 283/72
9,176,266 B2 11/2015 Fuhse et al.
(Continued)

FOREIGN PATENT DOCUMENTS

DE 102010047250 A1 6/2011
DE 102010048262 A1 4/2012
(Continued)

OTHER PUBLICATIONS

German Search Report from DE Application No. DE 10 2015 005 969.6, dated Apr. 4, 2016.
(Continued)

*Primary Examiner* — Kyle R Grabowski
(74) *Attorney, Agent, or Firm* — Workman Nydegger

(57) ABSTRACT

An optically variable security element having an areal motif region provided in a depiction region with a plurality of reflective, planar facets. Each planar facet is characterized by an inclination angle against the plane of the areal motif region, which inclination angle has, as inclination components, a parallel component parallel to a target curve in a center position, and a normal component perpendicular to the target curve in the center position. For the planar facets in the depiction region, a first of the two inclination components are chosen dependent on the distance of the respective facet from the target curve, and a second of the two inclination components being chosen in a predetermined spreading range independently of the distance of the respective facet from the target curve.

21 Claims, 6 Drawing Sheets

(51) Int. Cl.

| | |
|---|---|
| ***B42D 25/425*** | (2014.01) |
| ***B42D 25/29*** | (2014.01) |
| ***B42D 25/351*** | (2014.01) |
| ***B42D 25/373*** | (2014.01) |
| ***B42D 25/378*** | (2014.01) |
| *B42D 25/23* | (2014.01) |
| *B42D 25/24* | (2014.01) |
| *B42D 25/355* | (2014.01) |

(52) U.S. Cl.
CPC ..... *B42D 25/351* (2014.10); *B42D 25/373* (2014.10); *B42D 25/378* (2014.10); *B42D 25/425* (2014.10); *B42D 25/23* (2014.10); *B42D 25/24* (2014.10); *B42D 25/355* (2014.10)

(56) References Cited

U.S. PATENT DOCUMENTS

| | | | | |
|---|---|---|---|---|
| 9,676,156 | B2 | 6/2017 | Tompkin et al. | |
| 2006/0194040 | A1* | 8/2006 | Raksha | B42D 25/369 428/323 |
| 2006/0198998 | A1* | 9/2006 | Raksha | B42D 25/369 428/323 |
| 2012/0205905 | A1* | 8/2012 | Degott | B42D 25/29 283/72 |
| 2012/0319395 | A1 | 12/2012 | Fuhse et al. | |
| 2013/0093172 | A1* | 4/2013 | Fuhse | B42D 25/328 283/67 |
| 2014/0037898 | A1* | 2/2014 | Tompkin | B42D 25/324 428/141 |
| 2014/0160568 | A1* | 6/2014 | Fuhse | B42D 25/00 359/586 |
| 2015/0352883 | A1* | 12/2015 | Schmid | B42D 25/29 283/73 |
| 2016/0023495 | A1* | 1/2016 | Fuhse | B42D 25/328 359/566 |
| 2016/0325578 | A1* | 11/2016 | Ritter | B42D 25/328 |
| 2017/0021660 | A1* | 1/2017 | Petiton | B42D 25/324 |
| 2017/0239898 | A1 | 8/2017 | Tompkin et al. | |

FOREIGN PATENT DOCUMENTS

| | | | | |
|---|---|---|---|---|
| DE | 102010049831 | A1 | 5/2012 | |
| DE | 102011014114 | B3 | 5/2012 | |
| DE | 102011121653 | A1 | 6/2013 | |
| FR | 2942811 | A1 | 9/2010 | |
| WO | 2005052650 | A2 | 6/2005 | |
| WO | WO-2007079851 | A1 * | 7/2007 | B42D 25/328 |
| WO | WO-2010100360 | A1 * | 9/2010 | B42D 25/00 |
| WO | 2011066991 | A2 | 6/2011 | |
| WO | 2014108303 | A1 | 7/2014 | |

OTHER PUBLICATIONS

International Preliminary Report on Patentability from PCT Application No. PCT/EP2016/000734, dated Nov. 14, 2017.
International Search Report from PCT Application No. PCT/EP2016/000734, dated Aug. 1, 2016.

* cited by examiner

VISUALLY VARIABLE SECURITY ELEMENT

BACKGROUND

The present invention relates to an optically variable security element for securing valuable articles, a method for manufacturing such a security element and a data carrier that is equipped accordingly.

For protection, data carriers, such as value or identification documents, or other valuable articles, such as branded articles, are often provided with security elements that permit the authenticity of the data carriers to be verified, and that simultaneously serve as protection against unauthorized reproduction. Security elements having viewing-angle-dependent effects play a special role in safeguarding authenticity, as these cannot be reproduced even with the most modern copiers. Here, the security elements are furnished with optically variable elements that, from different viewing angles, convey to the viewer a different image impression and, depending on the viewing angle, display for example another color or brightness impression and/or another graphic motif.

In this context, optically variable security elements are known that display different movement or tilt effects when the security element is tilted, such as moving bars, moving pictorial depictions, pump effects or three-dimensional depictions. To implement the optically variable appearances, in the background art, different techniques are used that typically permit some of said movement effects to be realized particularly well and others less well.

For a three-dimensional depiction, typically, different views are provided for the left and right eye of the viewer in so-called stereographic methods, from which views a three-dimensional impression is then created. Here, a viewer sees an ostensibly identical image point with the left and right eye at different locations on the security element and then unconsciously calculates depth information via the corresponding parallaxes.

From document DE 10 2010 049 831 A1 is known, for example, an optically variable surface pattern that provides corresponding spatial views not only viewed from right and left, but also from top and bottom. Such a surface pattern offers a vertical as well as a horizontal parallax. While this has the advantage that such a surface pattern can be rotated arbitrarily in its plane without the spatial impression being lost, it simultaneously has the disadvantage that it requires many different views to be nested within one another, such that each view can occupy only a small areal fraction. The depictions are thus often relatively faint and in some cases are easily perceptible only when illuminated with a strong point light source.

Another approach to producing three-dimensional depictions having a horizontal and a vertical parallax is known from document DE 10 2010 048 262 A1. There, a depiction element is formed from individual "light spots" that are created in the focus of, for example, a concave or convex mirror or a metalized Fresnel lens. Such a depiction can be very bright and luminous provided that the surface regions associated with the individual light spots do not overlap too strongly, since in that case a nesting is likewise required and the brightness and luminance decreases. Luminous depictions can thus be produced only for images composed of relatively few light spots, which, however, results in a dotted and often sparsely detailed appearance.

A further possibility for producing depictions having a three-dimensional depth effect are offered by moiré magnification arrangements based on microlenses and microimages, as are known, for example, from document WO 2005/052650 A2. Here, a periodic depiction in the form of many small microimages is magnified by means of a grid composed of microlenses of similar but not exactly identical period. In this way, depending on the choice of the line screens, a depiction that apparently lies in front of or behind the actual surface pattern can result, or a so-called orthoparallactic movement can be produced. Disadvantageous in such moiré magnification arrangements, however, is the comparatively complex manufacture with two embossing steps for the microlenses and for embossed microimages, as well as the fact that only periodic depictions can be displayed.

Finally, it is known, for example from WO 2014/108303 A1, to align magnetically aligned reflective pigments, with magnets shaped accordingly, in such a way that bright, especially ring-shaped depictions result that likewise can comprise a certain depth effect. Such depictions are very bright and easily visible, but the required magnetic inks are comparatively expensive and the variety of effects and the resolution is limited by the availability of corresponding magnets.

SUMMARY

Proceeding from this, it is the object of the present invention to specify a security element of the kind mentioned above that overcomes the disadvantages of the background art and that especially displays a luminous and high-resolution depiction of a desired motif having a horizontal and a vertical parallax.

According to the present invention, a generic security element viewing-angle-dependently displays a motif having at least one curve depiction that, from a first viewing direction, is visible as a target curve in a center position within a depiction region and that, when the security element is tilted about two different predetermined axes, moves within the depiction region in different directions away from the center position.

According to the present invention, the security element comprises an areal motif region that is provided in the depiction region with a plurality of reflective, planar facets, each planar facet being characterized by an inclination angle against the plane of the areal motif region, which inclination angle has, as inclination components, a parallel component parallel to the target curve in the center position, and a normal component perpendicular to the target curve in the center position and, for the planar facets in the depiction region, a first of the two inclination components being chosen dependent on the distance of the respective facet from the target curve, and a second of the two inclination components being chosen in a predetermined spreading range independently of the distance of the respective facet from the target curve.

Since the curve depiction is visible as the target curve in the center position of the depiction region, within the scope of this description, the expression "distance from the target curve" is often used as an abbreviation for "distance from the center position in which the curve depiction is visible as the target curve". The two inclination components are normally specified by the value of the inclination angle of the planar facet in the respective direction.

The first inclination component of the planar facets advantageously increases or decreases monotonically, especially strictly monotonically, with the distance of the respective facet from the target curve. The first inclination component preferably even increases or decreases linearly with the distance of the respective facet from the target curve.

The second inclination component of the planar facets advantageously varies irregularly in the spreading range, especially according to a random distribution or a pseudo-random distribution. Pseudorandom numbers are strings of numbers that appear to be random but are calculated by a deterministic algorithm and thus, in the strict sense, are not true random numbers. Nevertheless, pseudo-random numbers are widely used, since the statistical properties of a pseudo-random distribution, such as equal probability of the individual numbers or the statistical independence of consecutive numbers, are normally sufficient for practical purposes, and pseudo-random numbers are easy to produce with computers, in contrast to true random numbers.

In principle, however, the spreading of the second inclination component can also be regular, for example in that all inclination values of the spreading range are run through in certain steps in succession at short intervals. If, for example, a spreading angle of 30° is to be achieved with facets measuring 5 μm, then 11 mirrors having deflection angles differing by 3° in each case can be arranged in succession. As a result, a periodic arrangement is created in which the corresponding inclination components repeat every 55 μm, which is not resolvable with the naked eye.

The first and second inclination component of the facets each have a certain angle range that is referred to below as the first or second angle range, respectively. Here, the size of the first angle range results from the size of the desired viewing range from which the effect is intended to be visible, and the specific increase or decrease of the facet inclination with the distance from the target curve, so it normally follows from the desired appearance and the desired movement behavior of the curve depiction. In particular, the first angle range also influences the dynamics or the apparent floating height or floating depth of the curve depiction. A small angle range thus causes the curve depiction to appear only in a small viewing angle range and relatively blurry; nevertheless, said depiction appears to lie at a great height or depth. In one advantageous embodiment, it is now provided that the size of the second angle range is chosen to be comparable with the size of the first angle range, and is advantageously between 80% and 120%, preferably between 90% and 110% of the size of the first angle range. The first and second angle range advantageously have a size of 15° or more, preferably of 30° or more.

In a preferred variant of the present invention, the first inclination component is the normal component (component perpendicular to the target curve in the center position) and the second inclination component the parallel component (component parallel to the target curve in the center position) of the facets. Here, for a viewer, the curve depiction floats below or above the plane of the areal motif region. As explained in greater detail below, the floating height or floating depth results from the type of dependence of the first inclination component on the distance from the curve. If the facets are inclined ever more strongly away from the curve with increasing distance from the curve, then, for the viewer, the curve depiction floats below the plane of the areal motif region; if, in contrast, the facets are developed to be inclined ever more strongly toward the curve with increasing distance, then the curve floats above the plane of the areal motif region. A rapid increase in the inclination angle effects a slight floating height or floating depth, and a slow increase, a great floating height or floating depth.

In another, likewise preferred variant of the present invention, the first inclination component is the parallel component and the second inclination component is the normal component of the facets. The curve depiction in this variant displays, when the security element is tilted, an orthoparallactic movement behavior in which the curve depiction moves perpendicular to the tilt direction and not, as one would intuitively expect, parallel to it.

As the target curve, the curve depiction can display a closed curve, but it can also display a curve having one or more curve ends. In the latter case, the spreading range of the second inclination component of the facets is advantageously diminished in the region of each of the curve ends compared with its size in the curve interior. In particular, below a certain distance, the spreading range can be continuously diminished toward the curve end, namely advantageously in such a way that either increasingly less light is reflected toward the curve interior (for floating heights below the areal motif region) or increasingly less light is reflected toward the curve exterior (for floating heights above the areal motif region). When viewed, the curve ends are then not visible from all viewing directions and the curve acquires, besides the horizontal parallax, also a vertical parallax. The viewer can then not only tilt the areal motif region having the curve depiction in different directions, but also rotate it arbitrarily in the plane of the motif region without the three-dimensional impression being lost.

The diminishing of the spreading range can be achieved, for example, in that facets are provided with inconspicuous patterns in the corresponding surface regions, for example are blackened or demetalized, or in that randomly oriented mirrors or other, non-directionally reflective patterns are provided there.

In advantageous embodiments, the curve depiction can display, as the target curve, alpha-numeric characters, symbols or geometric shapes, especially a circle, an oval, a triangle, a rectangle, a hexagon, or a star shape.

The motif can also include multiple curve depictions that display identical or different movement behaviors and/or identical or different floating heights or floating depths. In particular, the motif can include at least a first and a second curve depiction that, from a first or second viewing direction, respectively, is visible as the first or second target curve, respectively, in a center position within a first or second depiction region, respectively. The two curve depictions advantageously move in different, preferably opposing directions when the security element is tilted and thus produce a particularly dynamic appearance.

The depiction regions of the first and second curve depiction can be arranged in the areal motif region adjacent to one another or nested within one another. An adjacent arrangement of the depiction regions permits the production of particularly bright and luminous depictions, while nested embodiments are less bright, but in exchange, can depict two curves at the location, which especially in the case of different movement behaviors leads to conspicuous visual effects. For a nesting, for different curve depictions, the facets can be arranged alternatingly in the form of narrow strips or checkerboard-like in the form of small pixels.

It is understood that, in the same way, the motif of the security element can also include more than two curve depictions that can move in identical or different directions when the security element is tilted. For example, the curve depictions of an alphanumeric character string can alternatingly display different movement behaviors, for example float alternatingly above or below the plane of the areal motif region and, when tilted, move in accordance with its floating height.

In one advantageous embodiment, the planar facets are cast in an embossing lacquer layer and preferably provided with a reflection-increasing coating, especially a metalization, a reflective ink layer or a coating having a material having a high refractive index. Alternatively, the planar facets can also be embossed in a reflective ink layer. The reflection-increasing coating or the reflective ink layer expediently has a color-shift effect.

The security element advantageously constitutes a security thread, a tear strip, a security band, a security strip, a patch or a label for application to a security paper, value document or the like.

The areal motif region can be present in both a foil element and a printing element. A foil element is, for example, a security thread, security strip or security patch in which the areal motif region having the facets is embossed in an embossing lacquer layer and is provided with a reflection-increasing coating. Here, the facets preferably have maximum dimensions of less than 100 μm, particularly preferably less than 20 μm. At the same time, the facets are advantageously larger than 3 μm, preferably greater than 5 μm, in order to act ray-optically and without interfering color splittings due to diffraction effects. The facets can be arranged regularly, for example in the form of a sawtooth grating, or irregularly.

In a printing element, for example in banknote printing, the facets are advantageously produced by an embossing in a reflective background, such as a screen printing ink, a metallic-seeming printing ink having platelet-shaped reflective pigments, an optically variable ink or the like. Also an embossing or blind embossing in intaglio printing may be used. In printing elements, the dimensions of the facets are advantageously between 20 μm and 300 μm, preferably between 50 μm and 200 μm.

The present invention also includes a data carrier having a security element of the kind described, it being possible to arrange the security element both in an opaque region of the data carrier and in or over a transparent window region or a through opening in the data carrier. The data carrier can especially be a value document, such as a banknote, especially a paper banknote, a polymer banknote or a foil composite banknote, a stock, a bond, a certificate, a voucher, a check, a valuable admission ticket, but also an identification card, such as a credit card, a bank card, a cash card, an authorization card, a personal identity card or a passport personalization page.

The present invention further includes a method for manufacturing an optically variable security element of the kind described above, in which a desired target curve and a desired movement behavior of the target curve when the security element is tilted about two different axes are defined, a depiction region for the target curve is determined in which, when the security element is tilted, the target curve moves away from a center position in accordance with the defined movement behavior, in an areal motif region in the determined depiction region, a plurality of reflective, planar facets having an inclination angle against the plane of the areal motif region are arranged and aligned in such a way that they have, as inclination components, a parallel component parallel to the target curve in the center position, and a normal component perpendicular to the target curve in the center position, for the planar facets in the depiction region, a first of the two inclination components being chosen dependent on the distance of the respective facet from the target curve, and a second of the two inclination components being chosen in a predetermined spreading range independently of the distance of the respective facet from the target curve.

Further exemplary embodiments and advantages of the present invention are explained below by reference to the drawings, in which a depiction to scale and proportion was dispensed with in order to improve their clarity.

BRIEF DESCRIPTION OF THE DRAWINGS

Shown are.

DETAILED DESCRIPTION OF VARIOUS EMBODIMENTS

Figure 1:
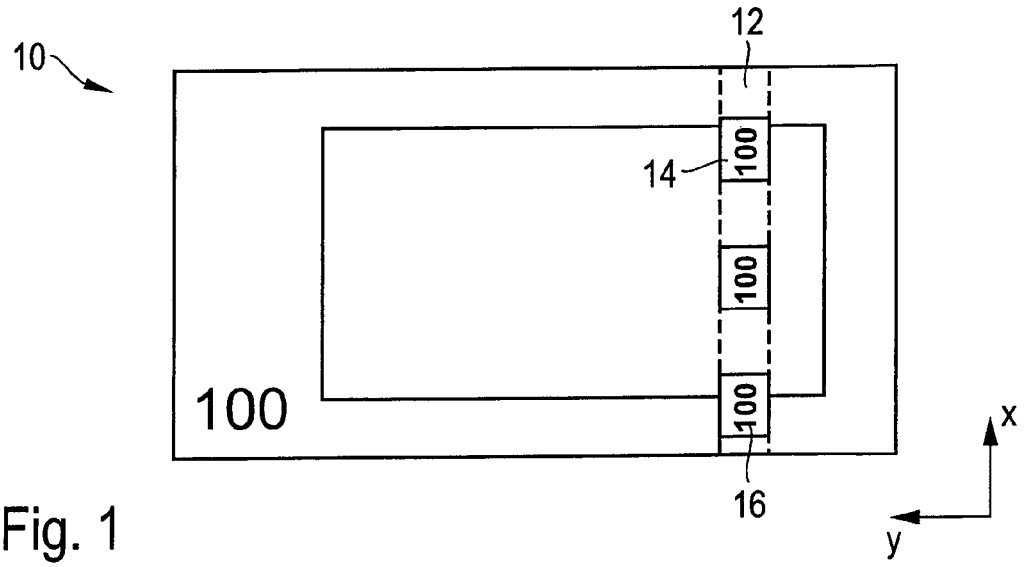
FIG. 1 a schematic diagram of a banknote having an optically variable security element according to the present invention, FIG. 2 schematically, a section of the areal motif region of the security element in FIG. 1, FIG. 3 a detailed section of FIG. 2, FIG. 4 schematically, a cross section through the areal motif region in FIG. 2 along the line IV-IV, FIGS. 5(*a*) and 5(*b*) illustrations of the reduced spreading range at the line ends, (a) showing a side view and (b) a top view of the depiction region of an extended vertical line, FIGS. 6(*a*) and 6(*b*) illustrations of the effect achieved by reducing the spreading range for two viewing directions, FIGS. 7(*a*) and 7(*b*) in (a), schematically, a top view of an areal motif region having a bent curve and in (b), a detailed view, FIG. 8 an areal motif region having a circular curve that floats below the motif region, in different views, FIG. 9 an areal motif region having a circular curve that floats above the motif region, in different views, FIG. 10 an areal motif region having a circular curve having orthoparallactic movement behavior, in different views, FIG. 11 an areal motif region having the value numeral "100" for producing a three-dimensional appearance having opposing movement effects, in different views, and FIG. 12 an areal motif region for depicting two circular curves having opposite orthoparallactic movement behavior, in different views.

The invention will now be explained using the example of security elements for banknotes. For this, FIG. 1 shows a schematic illustration of a banknote 10 having an inventive optically variable security element 12 in the form of a window security thread that emerges at certain window regions 14 on the surface of the banknote 10, while it is embedded in the interior of the banknote 10 in the regions lying therebetween. It is understood, however, that the present invention is not limited to security threads and banknotes, but rather can be used in all kinds of security elements, for example in labels on goods and packaging, or in safeguarding documents, identity cards, passports, credit cards, health cards and the like. In banknotes and similar documents, besides security threads, also for example wide security strips or transfer elements may be used.

In reflected light, in the window regions 14, the security thread 12 displays in each case a depiction of the value numeral "100" having an unusual three-dimensional appearance in which consecutive numbers "1" and "0" appear for the viewer to float alternatingly a few millimeters above or below the plane of the security thread 12. This three-dimensional appearance is amplified in that, when the banknote is tilted about the x-axis (transverse axis) or the y-axis (longitudinal axis), the numbers "1" and "0" appear to move in different directions in accordance with their apparent floating height or floating depth. This realistic reproduction of truly three-dimensional designs produces a conspicuous visual appearance having a high attention and recognition value.

The occurrence of the three-dimensional appearance and the movement effect when the security element 12 is tilted will now be explained in greater detail first with reference to FIGS. 2 to 4. Here, FIG. 2 shows a section of the areal motif region 20 of the security thread 12 that, for illustration, includes only one vertical line 16, FIG. 3 shows a detailed section of FIG. 2, and FIG. 4 shows, schematically, a cross section through the areal motif region 20 in FIG. 2 along the line IV-IV.

Figure 2:
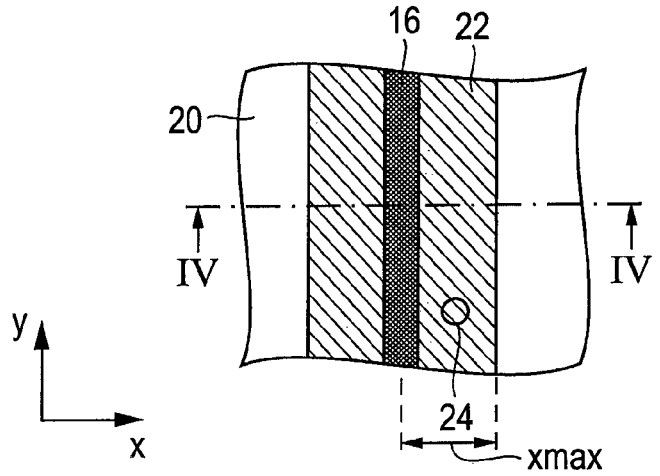
Figure 3:
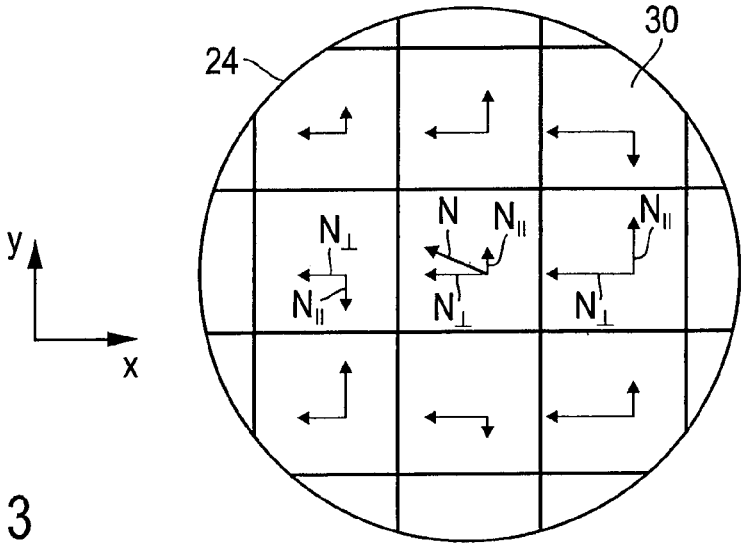
Figure 4:
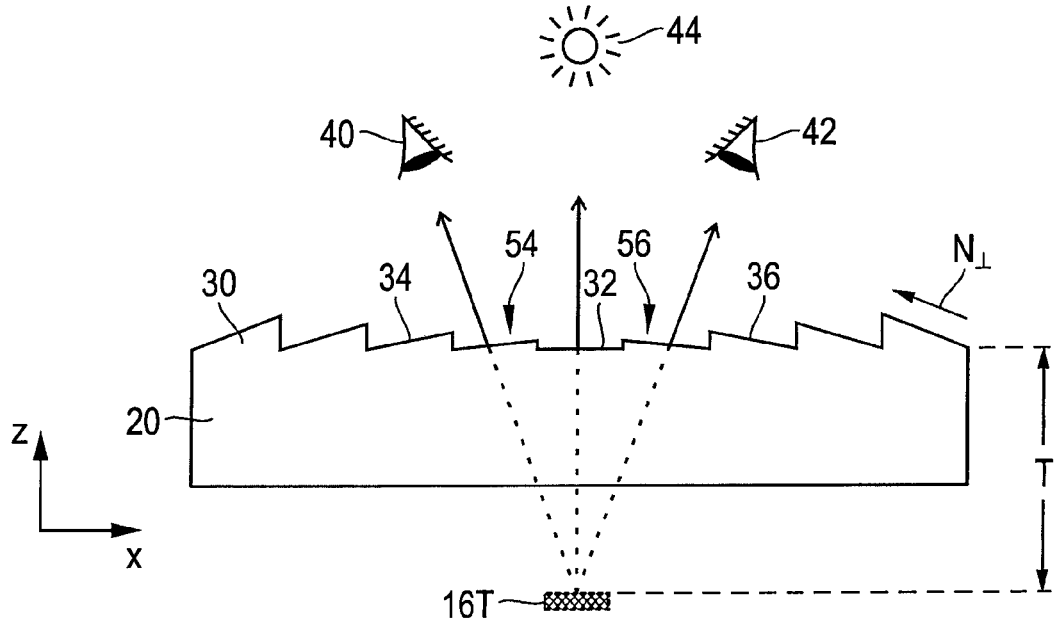

The vertical line 16 in FIGS. 2 to 4 serves, on one hand, as a simple example for illustrating the present invention, but the line 16 can also be part of a real, complex security element, for example, the vertical line 16 can depict the lower part of a number "1" in the value numeral "100" in the security thread 12 shown in FIG. 1.

The section in FIG. 2 shows, in top view, the areal motif region 20 of the security thread 12 having a depiction region 22 in whose center position the line 16 is visible as the target curve. For a viewer, the line 16 appears to float a few millimeters below the plane of the areal motif region 20 and to move from right to left or from left to right in the depiction region 22 when the security element is tilted about the y-axis (parallel to the line 16).

As shown in the detailed section 24 in FIG. 3, the depiction region 22 is provided with a plurality of reflective, planar facets 30 that have, for example, a base area of 15 μm×15 μm and a maximum height of a few micrometers. Each of the planar facets 30 is especially characterized by an inclination angle against the plane of the areal motif region 20, which inclination angle has, as inclination components, a parallel component $N_{\parallel}$ parallel to the line 16 (y-direction in FIGS. 2 and 3) and a normal component $N_{\perp}$ perpendicular to the line 16 (x-direction in FIGS. 2 and 3).

The ray-optically effective reflective facets 30 constitute small inclined micromirrors that direct incident light in a reflection direction given by the condition "angle of incidence equals angle of reflection". Within the scope of this description, the arrangement of the reflective facets 30 is thus also referred to as a micromirror arrangement.

Particularly the mirror slope or the facet slope in the respective direction can be calculated from the two inclination components $N_{\parallel}$ and $N_{\perp}$. For illustration, in the top view in FIG. 3, the inclination components of the facets 30 are marked as vectors whose direction indicates the direction of rising mirror level and whose absolute value indicates the slope in the respective direction. The inclination components $N_{\parallel}$ and $N_{\perp}$ yield, as usual, the total slope N of a facet 30, which is additionally marked for the middle facet in FIG. 3. As evident from FIG. 3, the direction of the total slope N of a facet 30 is normally not parallel to an external boundary line of the facet. In the exemplary embodiment, facets are shown having a quadratic base area, but also other shapes, for example triangular, rectangular, hexagonal or polygonal base area shapes may be used.

The cross section in FIG. 4 extends in the x-direction in FIG. 2 and thus shows, as the facet slope, only the normal component $N_{\perp}$ perpendicular to the line 16 and parallel to the x-axis.

For the line 16 to apparently float a few millimeters below the plane of the areal motif region 20, the line 16 must be visible for the right and left eye of a viewer at positions in the motif region 20 that are offset somewhat against each other. The resulting parallax is then interpreted unconsciously and automatically by the viewer as depth information and produces a corresponding appearance.

With reference to FIG. 4, said offset is achieved in the exemplary embodiment in that the facets 30 in the center position of the depiction region 22 are developed to be uninclined in the x-direction (facets 32), that is, they have an inclination angle of 0° in the x-direction, and in that, toward the outside, the facets are developed to be inclined ever more strongly outwardly with increasing distance from the center position (facets 34 and 36). If the lighting is given by a light source 44 arranged perpendicularly over the areal motif region 20, then the facets 32, 34, 36 reflect the incident light in accordance with the reflection directions marked in FIG. 4. Seen from a position 40 corresponding, for example, to the position of the left eye of the viewer, the facets 34 then light up at the position 54 of the areal motif region 20, while, seen from a position 42 corresponding to the position of the right eye of the viewer, the facets 36 light up at the position 56 of the areal motif region 20. The offset between the positions 54 and 56 is automatically interpreted by the viewer in such a way that he sees a bright line 16T floating at a depth T below the areal motif region 20.

As illustrated in FIGS. 3 and 4, the normal component $N_{\perp}$ of the facet inclination in the exemplary embodiment is chosen in such a way that, toward the outside, the inclination angle of the facets 34, 36 increases linearly with the distance of the facets from the center position. If, for instance, $x_0$ designates the center position of the line 16 and $x_{max}$ the dimension of the depiction region in the +x and −x-direction (see FIG. 2), then, in the exemplary embodiment, the inclination angle in the x-direction of a facet 30 in position (x,y) is given by:

$$\alpha_{\perp}(x,y)=-A_x(x-x_0)/x_{max} \quad (1)$$

Here, a positive inclination angle indicates an inclination in which the facet rises in the +x-direction, and a negative inclination angle, an inclination in which the facet falls in the +x-direction. The inclination angle of the facets in the x-direction then changes from $\alpha_{\perp}=0°$ up to a maximum value $|\alpha_{\perp}|=A_x$, which can be, for example, 20°. The inclination always occurs in such a way that the facets 34, 36 are inclined away from the center position of the line 16, that is, outwardly. In the exemplary embodiment, the size of the first angle range is $2*A_x=40°$.

As can likewise be inferred from FIG. 4, a slow increase in the inclination angle in the x-direction leads to a small offset 54-56 and thus to a large apparent depth T of the line 16T, while a rapid increase in the inclination angle leads to a large offset and thus to a small apparent depth T of the line 16T.

What is particularly important presently is that the perpendicular inclination angle of the facets is dependent on the distance $(x-x_0)$ of the facets from the center position of the line 16, especially increases monotonically or, as in the exemplary embodiment, even increases linearly with the distance.

For such a choice of the perpendicular inclination angle of the facets 30, the viewer can tilt the security element having the areal motif region 20 in a wide angle range left or right about the y-axis and, in doing so, he always sees the bright line 16T at the depth T.

As a distinctive feature, the inclination of the facets 30 of the areal motif region 20 has, in addition to the normal component $N_{\perp}$, also a non-vanishing parallel component $N_{\parallel}$, parallel to the line 16, whose value varies randomly in an angle range whose size is comparable with the size of the first angle range in the x-direction. Specifically, the inclination angle of a facet 30 in the position (x,y) parallel to the line 16 in the exemplary embodiment is given by:

$$\alpha_{\parallel}(x,y)=A_y*\mathrm{rand}(-1,1), \quad (2)$$

Wherein rand(−1,1) is a function that yields a random number or pseudorandom number in the interval [−1,1], and $A_y$ indicates the maximum parallel inclination angle. For example, $A_y=A_x$ can be chosen, such that the first angle range ($2*A_x$) and the second angle range ($2*A_y$) have the same size. A positive inclination angle $\alpha_{\parallel}$ indicates an inclination at which the facet rises in the +y-direction, and a negative inclination angle, an inclination at which the facet falls in the +y-direction.

As can be seen from relationship (2), the parallel inclination angle $\alpha_{\parallel}$ of the facets 30 is independent of the distance of the facets from the center position of the line 16. Through such a distance-independent and especially random variation of the parallel inclination angle, a spreading of the incident light parallel to the line 16 is achieved whose size is comparable with the parallax effect due to the perpendicular inclination angle $\alpha_{\perp}$. The additional parallel component $N_{\parallel}$ ensures that a viewer still sees the line 16 floating at the depth T even if he tilts the security element upward or downward about the x-axis by a certain angle within the second angle range.

To now obtain the spatial appearance not only upon tilting, but also upon arbitrary rotation of the security element, for a vertical line 16, the parallel component $N_{\parallel}$ of the facets 30 is modified in such a way that, at the line ends, incident light is not spread in the entire angle range, but rather only in a sub-range thereof, such that the visibility of the line ends is dependent on the viewing direction.

Figure 5A:
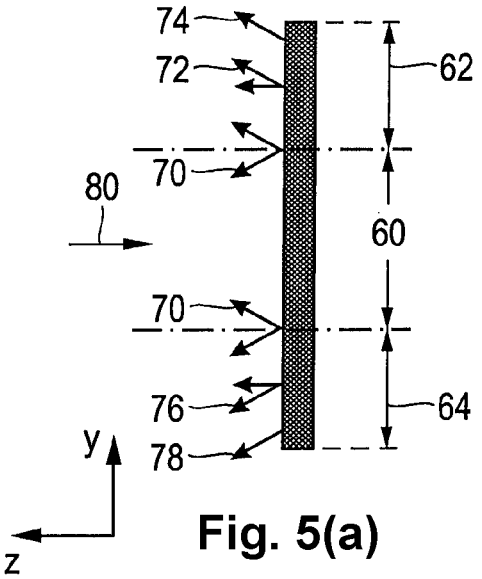
Figure 5B:
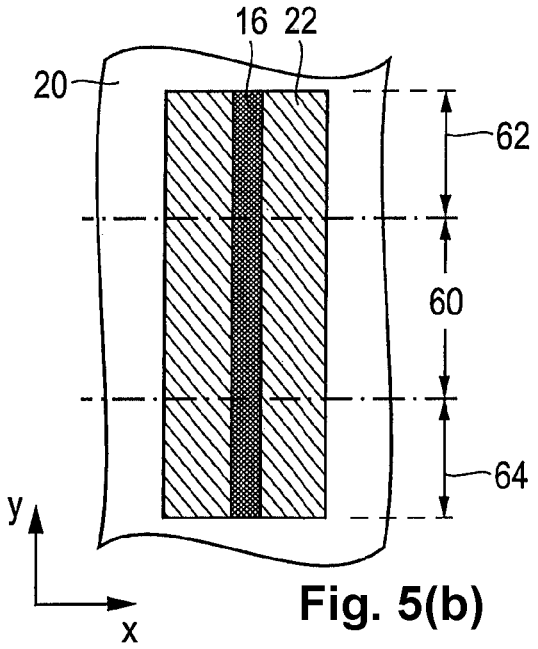

For illustration, FIG. 5(*b*) shows the depiction region 22 of an extended vertical line 16 within the areal motif region 20, in top view. The inclination angles $\alpha_{\perp}$ in the x-direction of the facets 30 are given by the above-mentioned relationship (1) in the entire depiction region 22. The inclination angles $\alpha_{\parallel}$ in the y-direction are given by the relationship (2) in a core region 60 of the depiction region 22, such that the full spreading range is exploited there. In the edge regions 62 and 64 of the depiction region 22, the relationship (2) is modified to reduce the spreading range and, in this way, to limit the visibility of the line ends.

For this, the side view in FIG. 5(*a*) shows the spreading range 70 of the line 16 in the core region 60, which spreading range spreads light incident from direction 80 according to relationship (2) in an angle range [$-A_y$, $A_y$], for example [−20°, 20°]. In the upper edge region 62, the spreading range is continuously limited from below, a spreading range 72 having an angle range [0°, $A_y$] and a spreading range 74 lying very close to the upper edge of the line 16 having an angle range [$0.8*A_y$, $A_y$] being shown. Accordingly, the spreading range in the lower edge region 64 is continuously limited from above, a spreading range 76 having an angle range [$-A_y$, 0°] and a spreading range 78 lying very close to the lower edge of the line 16 having an angle range [$-A_y$, $-0.8*A_y$] being shown.

Figure 6A:
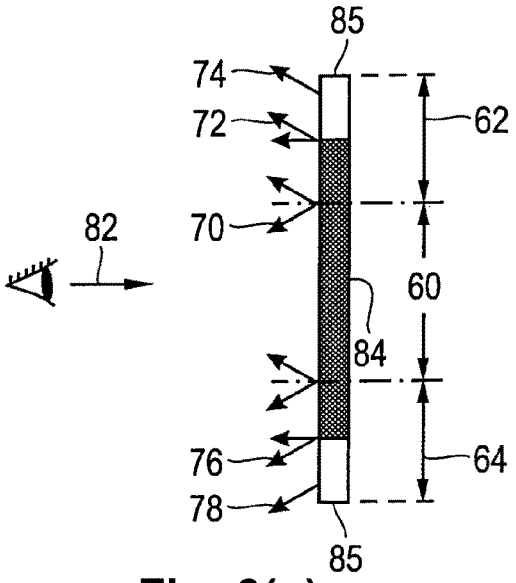
Figure 6B:
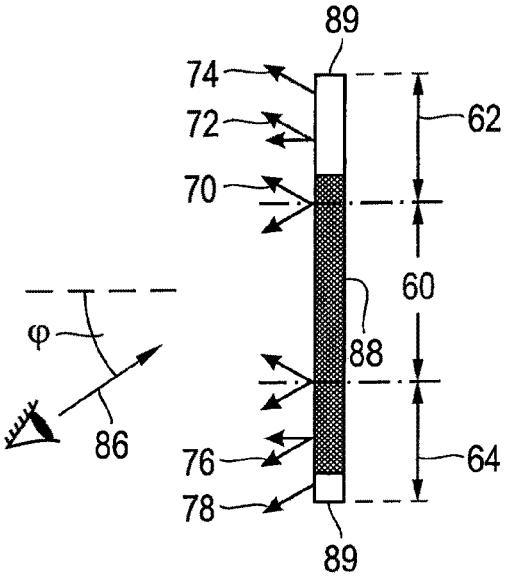

The effect achieved by reducing the spreading range is illustrated in FIG. 6 for two viewing directions for $A_y$=20°. In the perpendicular view 82 shown in FIG. 6(*a*) (corresponding to a viewing angle φ=0°), the viewer sees that portion 84 of the line 16 in which the spreading range includes the angle φ=0°. The visible line portion 84 thus includes the core region 60 and equal-sized portions of both the upper and the lower edge region 62, 64. The outermost edges 85 of the line 16 are not visible, since they do not reflect at the angle φ=0°. For example, the spreading range 74 comprises only an angle range of 16° to 20°, and the spreading range 78, only an angle range of −20° to −16°.

In the view 86, shown in FIG. 6(*b*), obliquely from below at an angle φ=−10°, the viewer sees that portion 88 of the line 16 in which the spreading range includes the angle φ=−10°. The visible line portion 88 thus includes the core region 60, a small portion of the upper edge region 62 and a larger portion of the lower edge region 64. For example, the line is visible in the spreading range 76, since the angle range from −20° to 0° includes the viewing angle φ=−10°. In contrast, the spreading range 72 comprises only the angle range from 0° to 20°, so does not reflect at an angle of φ=−10°. The line ends 89 having the spreading ranges 74 and 78 are not visible from the viewing direction 86, a larger non-visible portion resulting at the upper end and a smaller one at the lower line end.

As a result, due to the change in the viewing direction or due to a tilting of the security element, the visible line portion 84, 88 appears to have migrated downward, which constitutes precisely the expected movement behavior of an object floating below the areal motif region 20. In this way, the line 16 acquires, besides the horizontal parallax due to the choice of the normal component $N_{\perp}$, also a vertical parallax due to the described choice of the parallel component $N_{\parallel}$. A viewer can thus not only tilt an areal motif region 20 having a line 16 in the x- and y-direction, but also arbitrarily rotate it in the x-y plane without the three-dimensional depth impression being lost.

The depiction in FIG. 5 applies to floating heights below the areal motif region 20. For lines intended to float above the areal motif region, the spreading range must accordingly be limited continuously from above in the upper edge region and continuously from below in the lower edge region.

Figure 7A:
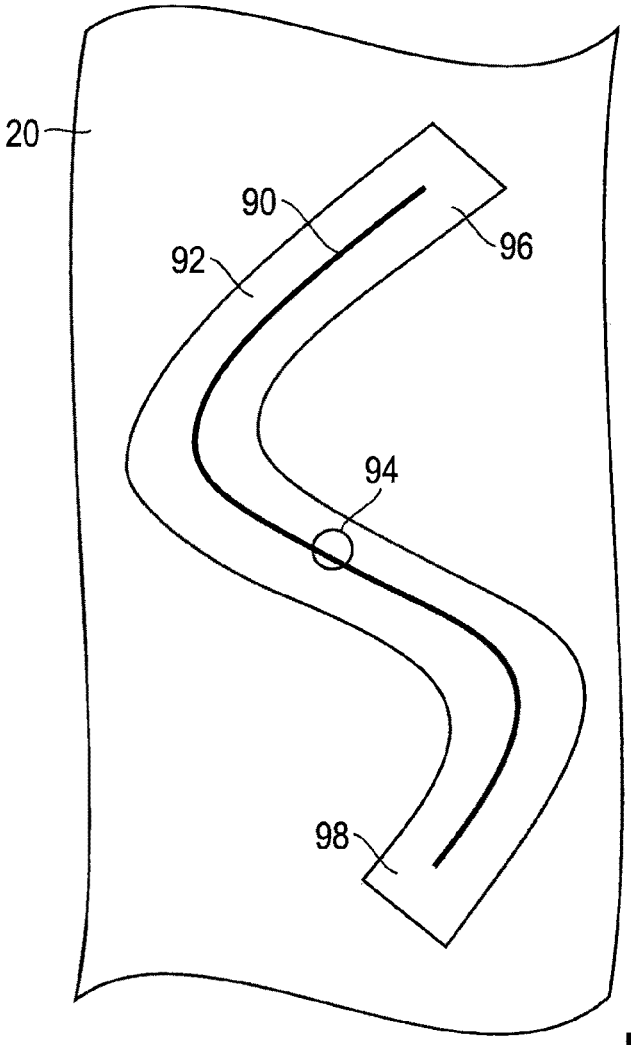
Figure 7B:
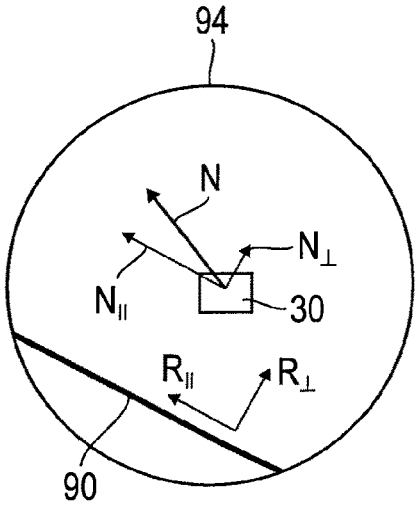

The approach first described for a vertical line 16 can generally be used for arbitrary bent curves 90, as illustrated in FIG. 7. FIG. 7 shows, in top view, an areal motif region 20 of a security element having a depiction region 92 in whose center position the bent curve 90 is visible as the target curve. For a viewer, the line 90 floats a few millimeters below the plane of the areal motif region 20 and, when tilted about the x-axis or the y-axis, moves in different directions in accordance with its apparent floating height or floating depth.

Since the bent curve 90 can be described locally by small straight line segments, the above considerations for a line 16 can easily be transferred to the bent curve 90 if the y-direction (parallel to the line 16) is replaced by a local direction vector $R_{\parallel}$ parallel to the curve 90, and the x-direction by a local direction vector $R_{\perp}$ perpendicular to the curve 90.

With reference to the detailed section 94 in FIG. 7(*b*), the depiction region 92 is provided with a plurality of reflective, planar facets 30 that are characterized especially by an inclination angle against the plane of the areal motif region 20, which inclination angle has, as inclination components, a parallel component $N_{\parallel}$ parallel to the local direction vector $R_{\parallel}$ and a normal component $N_{\perp}$ parallel to the local direction vector $R_{\perp}$.

Here, the normal component $N_{\perp}$ of the facet inclination is dependent on the distance of a facet 30 from the bent curve 90. In particular, the inclination angle parallel to the direction vector $R_{\perp}$ can increase monotonically and preferably linearly with the distance of the facet from the curve 90. If the facets are developed to be inclined ever more strongly away from the curve with increasing distance from the curve, then the curve appears to float below the plane of the areal motif region 20. If, on the other hand, the facets are developed to be inclined ever more strongly toward the curve with increasing distance from the curve, then the curve appears to float above the plane of the areal motif region 20. It is understood that a curve need not have a constant floating height, but rather that the floating height can change along the curve and even transition from a floating height above the areal motif region to a floating height below the areal motif region or vice versa.

The parallel component $N_{\parallel}$ of the facet inclination is chosen independently of the distance of a facet from the bent curve and varies randomly or pseudorandomly in a second angle range whose size is comparable with the angular spread parallel to the direction vector $R_{\perp}$ (first angle range). At the ends 96, 98 of the curve 90, the spreading range of the parallel component $N_{\parallel}$ is limited to a sub-region, as described above for a vertical line 16, to make the visibility of the line ends dependent on the viewing angle in accordance with the desired floating height. A viewer can then not only tilt the areal motif region 20 having the bent curve 90 in the x- and y-direction, but also rotate it arbitrarily in the x-y plane without the three-dimensional depth impression being lost.

If the curve 90 is a closed curve, a limitation of the spreading range at line ends is, of course, not required. The curve 90 can have any shape, but preferably depicts letters, numbers, symbols or also simple geometric shapes such as circles, ovals, triangles, rectangles or squares.

Figure 8:
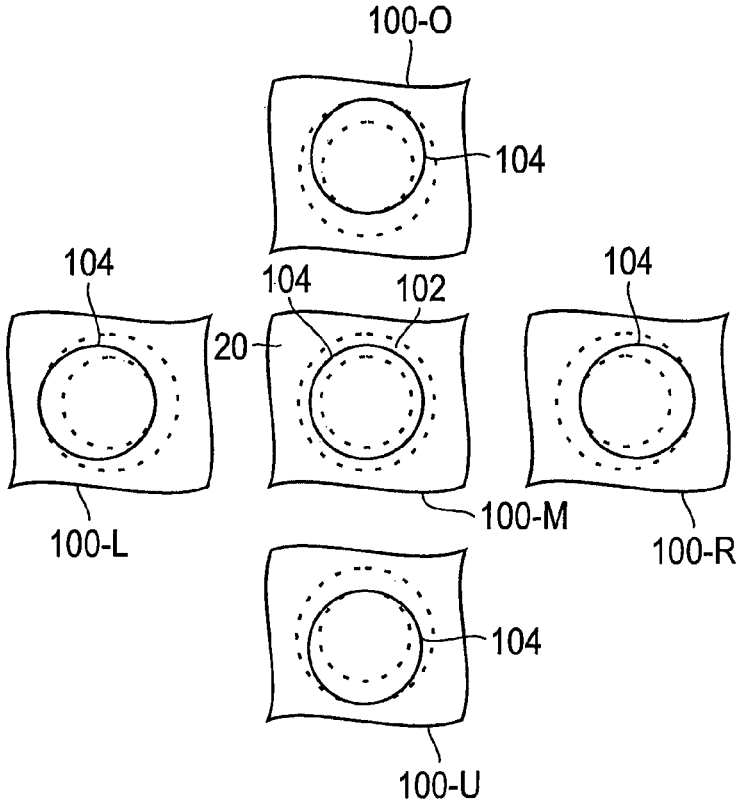

The principle according to the present invention also permits the creation of more general movement effects. For explanation, in FIGS. 8 and 9, the previously described movement effects for a motif having a ring in the form of a circular curve 104 are first summarized again. In FIG. 8, the middle view 100-M shows, in top view, an areal motif region 20 having a depiction region 102, marked in dotted lines, in which the circular curve 104 is visible in the center position when viewed perpendicularly and appears to float below the areal motif region 20. When viewed from above (view 100-O), the circular curve 104 migrates to the upper edge of the depiction region 102, and when viewed from below (view 100-U), to the lower edge. Accordingly, the circular curve 104 migrates, when viewed from the right (view 100-R), to the right edge of the depiction region 102, and when viewed from the left (view 100-L), to the left edge. Such a movement behavior corresponds to the movement behavior of an object arranged at depth and thus creates the three-dimensional impression of the ring floating at depth.

As already described in connection with FIG. 7, said appearance and movement behavior is achieved, for example, in that the facets in the depiction region 102 are inclined toward perpendicular to the direction vector $R_{\parallel}$ of the circular curve 104, away from the circular curve 104, and the inclination angles increase linearly with the distance of the facet from the circular curve 104, and in that the inclination angles parallel to the direction vector $R_{\parallel}$ vary, independently of the distance from the circular curve 104, randomly or pseudorandomly in a spreading range whose size is comparable with the angular spread perpendicular to the direction vector $R_{\parallel}$.

Figure 9:
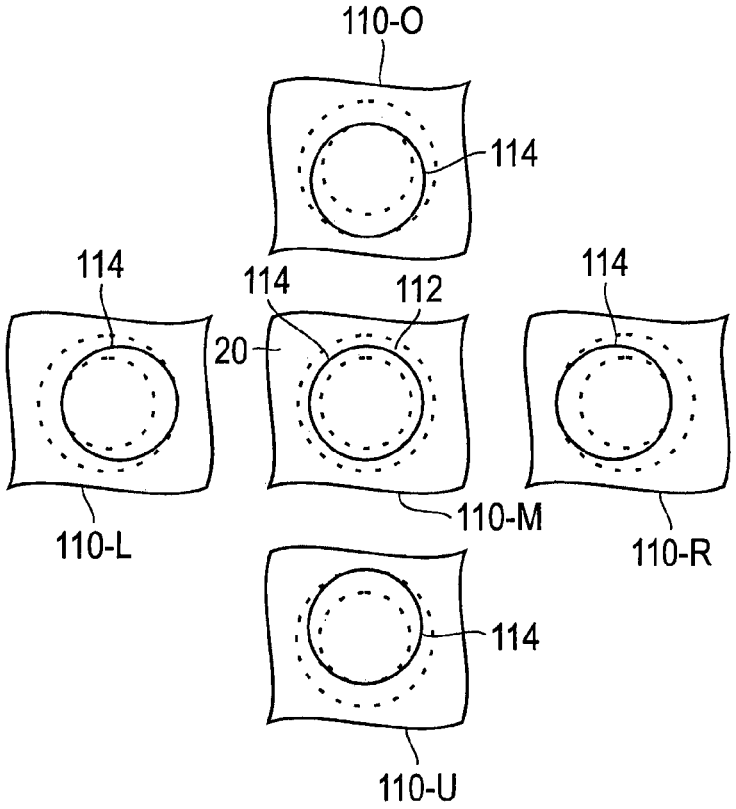

In FIG. 9, the middle view 110-M shows, in top view, an areal motif region 20 having a depiction region 112, marked in dotted lines, in which the circular curve 114 is visible in the center position when viewed perpendicularly and appears to float above the areal motif region 20. In this case, the circular curve 114 migrates, when viewed from above (view 110-O), to the lower edge of the depiction region 112, and when viewed from below (view 110-U), to the upper edge, when viewed from the right (view 110-R), to the left edge, and when viewed from the left (view 110-L), to the right edge of the depiction region 112. Such a movement behavior corresponds to the movement behavior of an object arranged above the motif region 20 and thus creates the three-dimensional impression of the ring floating above the motif region.

Such an appearance and movement behavior is achieved, for example, in that the facets in the depiction region 112 are inclined toward perpendicular to the direction vector $R_{\parallel}$ of the circular curve 114, toward the circular curve 114, and the inclination angles increase linearly with the distance of the facet from the circular curve 114, and in that the inclination angles parallel to the direction vector $R_{\parallel}$ vary, independently of the distance from the circular curve 114, randomly or pseudorandomly in a spreading range whose size is comparable with the angular spread perpendicular to the direction vector $R_{\parallel}$.

Figure 10:
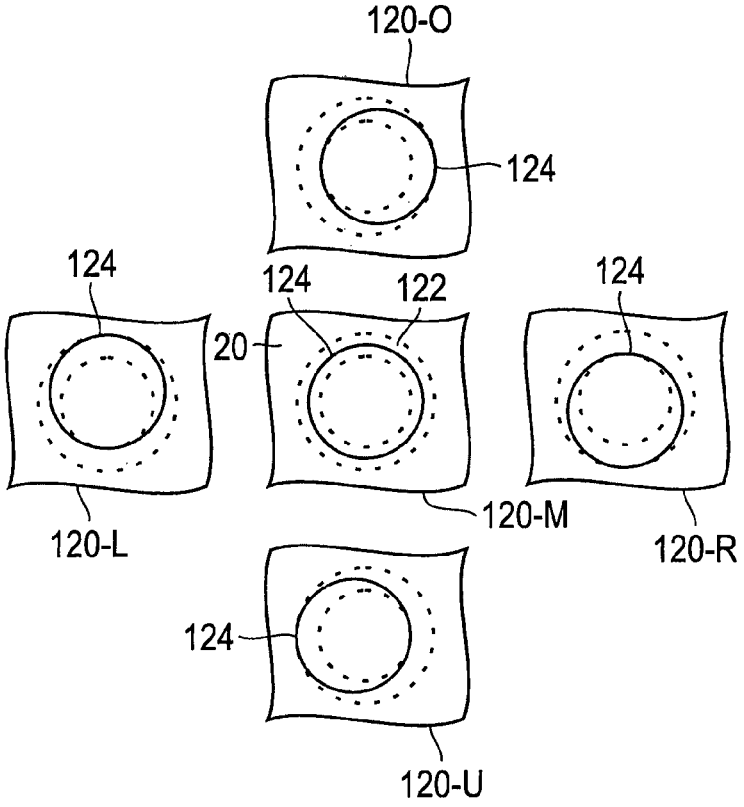

Instead of an intuitively correct movement behavior according to FIG. 8 or 9, with the described micromirror embodiments, also curve depictions having a counterintuitive movement behavior can be produced, in which the movement behavior does not correspond to that of a real object. For this, FIG. 10 shows, in turn, a ring 124 as the motif, but for the facets in the depiction region 122, the role of the components $N_{\perp}$ and $N_{\parallel}$ is reversed in relation to the embodiments in FIGS. 8 and 9. Thus, for each facet in the depiction region 122, the parallel component $N_{\parallel}$ is inclined parallel to the direction vector $R_{\parallel}$ of the circular curve 124, namely having inclination angles that increase linearly with the distance of the facet from the circular curve 114. In contrast, the inclination angles perpendicular to the direction vector $R_{\parallel}$ vary, independently of the distance from the circular curve 114, randomly or pseudorandomly in a spreading range whose size is comparable with the angular spread parallel to the direction vector $R_{\parallel}$.

Specifically, in FIG. 10, the middle view 120-M shows, in top view, an areal motif region 20 having a depiction region 122, marked in dotted lines, in which the circular curve 124 is visible in the center position when viewed perpendicularly. When viewed from above (view 120-O), the circular curve 124 migrates, contrary to expectation, to the right edge of the depiction region 122, and when viewed from below (view 120-U), to the left edge. Accordingly, the circular curve 124 migrates, when viewed from the right (view 120-R), to the lower edge of the depiction region 122, and when viewed from the left (view 120-L), to the upper edge. Such a movement behavior is referred to as an orthoparallactic movement, since the apparent movement of the circular curve 124 is always perpendicular to the tilt direction and to the intuitively expected movement direction.

With the reverse sign of the facet inclination parallel to the direction vector $R_{\parallel}$, the reverse movement effect can, of course, also be produced, that is, in which the circular curve 124 migrates, when viewed from above, to the left edge of the depiction region 122, etc.

A switching of the roles of the components $N_{\perp}$ and $N_{\parallel}$ corresponds to a rotation of the inclination of the facets or micromirrors by +90° or 90°. Also combinations of height/depth effects and orthoparallactic movement effects can be produced if, proceeding from a height or depth effect, the inclination of the facets is rotated by an arbitrary angle that is not an integer multiple of 90°.

Figure 11:
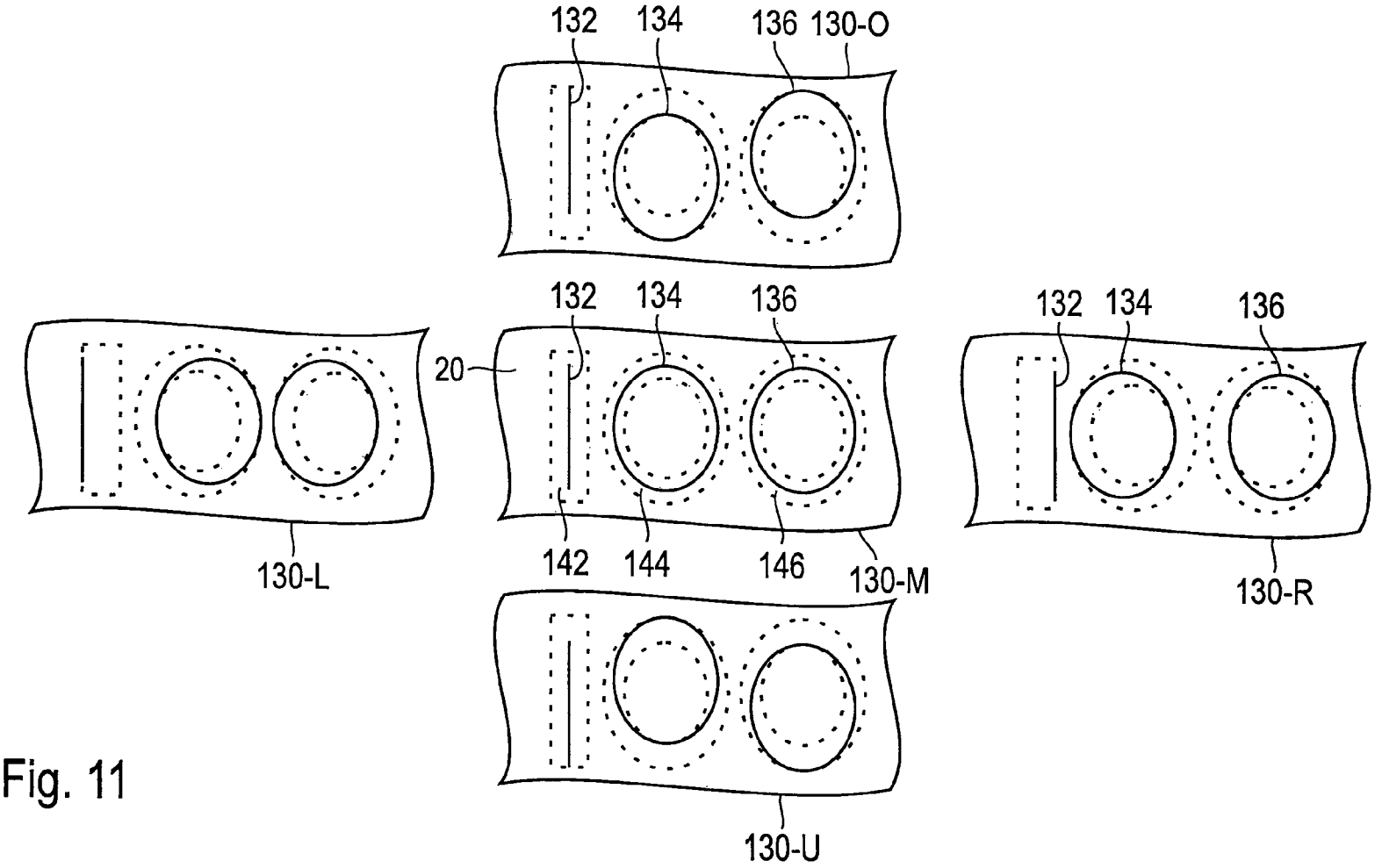

The above-mentioned effects can be combined with one another, for example to produce the unusual three-dimensional appearance mentioned for FIG. 1. For this, with reference to FIG. 11, for the value numeral "100", the numbers "1", "0" and "0" are laid out as curve depictions 132, 134, 136 in an areal motif region 20 having their respective depiction regions 142, 144, 146 in such a way that the curve depictions 132 and 136 according to FIG. 8 appear to float below the motif region 20, and the curve depiction 134 according to FIG. 9, above the motif region 20 (view 130-M). When viewed from above (view 130-O), the curve depictions 132 and 136 then migrate to the upper edge of their respective depiction region, while the curve depiction 134 migrates to the lower edge of its depiction region. When viewed from below (view 130-U), the reverse appearance results, such that the numbers appear to move against each other and past each other when tilted from top to bottom.

Similarly, the curve depictions 132 and 136 migrate, when viewed from the right (view 130-R), to the right edge of their respective depiction region, while the curve depiction 134 migrates to the left edge of its depiction region. When viewed from the left (130-L), in turn, the reverse appearance is seen, such that the numbers appear to approach or move away from each other when tilted from left to right.

Such depictions are very conspicuous and dynamic and thus particularly well suited as security elements for banknotes or other value documents. Instead of combining different height and depth effects, also different orthoparallactic movement effects can, of course, be combined, or height and depth effects on the one hand be combined with orthoparallactic movement effects on the other.

Due to the smallness of the facets, also multiple curve depictions and movement effects can be arranged nested in the same surface region. For example, first facets for a first curve depiction having a first movement effect and second facets for a second curve depiction having a second movement effect can be arranged nested within one another checkerboard-like.

Figure 12:
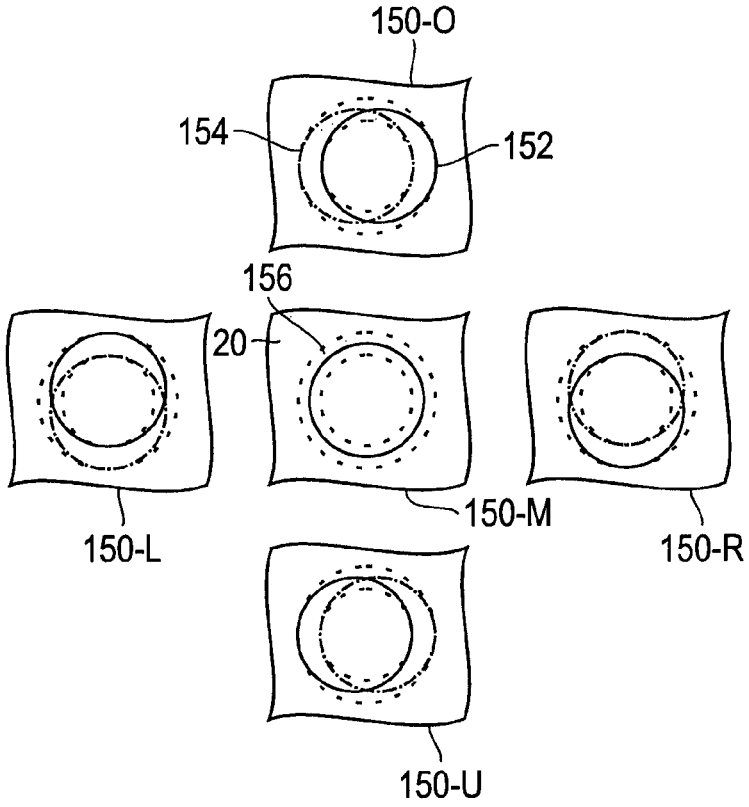

With reference to FIG. 12, the areal motif region 20 can, for example, include a motif composed of two circular curves 152, 154 that are arranged within the same depiction region 156 and that are depicted by first or second facets, respectively, arranged checkerboard-like. Here, the two circular curves 152, 154 each display opposing orthoparallactic movement behaviors, as already explained in principle for FIG. 10. In particular, for each facet in the depiction region 156, the parallel component $N_{||}$ is inclined parallel to the direction vector $R_{||}$ of the circular curves 152, 154, namely having inclination angles that, in terms of absolute value, increase linearly with the distance of the facet from the center position of the circular curves (view 150-M).

To produce the opposite orthoparallactic movement, the inclination angle of the second facets parallel to the direction vector $R_{||}$ is chosen to be identical in terms of absolute value, but opposite the corresponding inclination angle of the first facets. For both types of facets, the inclination angles perpendicular to the direction vector $R_{||}$ are chosen, independently of the distance from the center position of the circular curves 152, 154, randomly or pseudorandomly in a spreading range whose size is comparable with the angular spread parallel to the direction vector $R_{||}$.

Through said design of the facets, the movement behavior illustrated in FIG. 12 of the areal motif region 20 results, in which the circular curve 152 displays the orthoparallactic movement behavior already described in FIG. 10, and the circular curve 154, the opposite orthoparallactic movement behavior, as illustrated in the views 150-O, 150-U, 150-R and 150-L, which show views when viewed from above, below, right and left, respectively. Very dynamic effects can also be produced through a nesting, since multiple curve depictions display different movement effects even within the same surface region. Due to the nesting of two types of facets, the individual rings naturally have a lower brightness, but the surface regions produced by the facets are normally so bright anyway that also the lower brightness of nested depictions is completely sufficient for many purposes.

LIST OF REFERENCE SIGNS

10 Banknote
12 Optically variable security element
14 Window regions
16 Line
16T Bright line at depth T
20 Areal motif region
22 Depiction region
24 Detailed section
30, 32, 34, 36 Reflective, planar facets
40, 42 Position of the left and right eye, respectively
44 Light source
54, 56 Location of the surface region
60 Core region
62, 64 Edge regions
70, 72, 74, 76, 78 Spreading range
80, 82, 86 Viewing directions
84, 88 Visible line portions
85, 89 Line ends
90 Bent curve
92 Depiction region
94 Detailed section
96, 98 Curve ends
100-M, O, U, R, L Views
102 Depiction region
104 Circular curve
110-M, O, U, R, L Views
112 Depiction region
114 Circular curve
120-M, O, U, R, L Views
122 Depiction region
124 Circular curve
130-M, O, U, R, L Views
132, 134, 136 Curve depictions
142, 144, 146 Depiction regions
150-M, O, U, R, L Views
152, 154 Circular curves
156 Depiction region

The invention claimed is:

1. An optically variable security element for securing valuable articles that viewing-angle-dependently displays a motif having at least one curve depiction that, from a first viewing direction, is visible as a target curve in a center position within a depiction region and that, when the security element is tilted about two different predetermined axes, moves within the depiction region in different directions away from the center position, having an areal motif region that is provided in the depiction region with a plurality of reflective, planar facets, each planar facet being characterized by an inclination slope against the plane of the areal motif region, which inclination slope has, as inclination components, a parallel component parallel to the target curve in the center position, and a normal component perpendicular to the target curve in the center position, wherein a direction of a vector defining each inclination component indicates the respective direction of rising facet level and an absolute value of the vector defining each inclination component indicates the slope in the respective direction, such that the inclination components together yield the total slope N of the planar facet; and for the planar facets in the depiction region, a first of the two inclination components being chosen dependent on the distance of the respective facet from the target curve, and a second of the two inclination components being chosen in a predetermined spreading angle range independently of the distance of the respective facet from the target curve, wherein the second inclination component of the planar facets varies irregularly in the spreading angle range.

2. The security element according to claim 1, wherein the first inclination component of the planar facets increases or decreases monotonically, with the distance of the respective facet from the target curve.

3. The security element according to claim 2, wherein the first inclination component of the planar facets increases or decreases strictly monotonically with the distance of the respective facet from the target curve.

4. The security element according to claim 2, wherein the first inclination component of the planar facets increases or decreases linearly with the distance of the respective facet from the target curve.

5. The security element according to claim 1, wherein the second inclination component of the planar facets varies irregularly in the spreading angle range according to a random distribution or a pseudorandom distribution.

6. The security element according to claim 1, wherein the planar facets are cast in an embossing lacquer and are provided with a reflection-increasing coating.

7. The security element according to claim 1, wherein the first and second inclination component of the facets have a first or a second spreading angle range, respectively, and in that the size of the second spreading angle range is between 80% and 120% of the size of the first spreading angle range.

8. The security element according to claim 1, wherein the first inclination component is the normal component and the second inclination component is the parallel component of the facets, and in that, for a viewer, the curve depiction floats below or above the plane of the areal motif region.

9. The security element according to claim 1, wherein the first inclination component is the parallel component and the second inclination component is the normal component of the facets, and in that the curve depiction displays an orthoparallactic movement behavior when the security element is tilted.

10. The security element according to claim 1, wherein, as the target curve, the curve depiction displays a closed curve.

11. The security element according to claim 1, wherein, as the target curve, the curve depiction displays a curve having one or more curve ends, and in that the spreading angle range of the second inclination component of the facets is diminished in the region of each of the curve ends compared with its size in the curve interior.

12. The security element according to claim 11, wherein a surface of the planar facets in the region of each of the curve ends are blackened or demetallized.

13. The security element according to claim 11, wherein in the region of each of the curve ends randomly oriented mirrors or other, non-directionally reflective patterns are provided.

14. The security element according to claim 1, wherein, as the target curve, the curve depiction displays an alphanumeric character, a symbol or a geometric shape, selected from the group of a circle, an oval, a triangle, a rectangle, a hexagon, and a star shape.

15. The security element according to claim 1, wherein the motif includes at least a first and a second curve depiction that, from a first or second viewing direction, respectively, is visible as the first or second target curve, respectively, in a center position within a first or second depiction region, respectively, the two curve depictions moving in different directions when the security element is tilted.

16. The security element according to claim 15, wherein, in the areal motif region, the depiction regions of the first and the second curve depiction are arranged adjacent to each other or nested within one another.

17. The security element according to claim 15, wherein the two curve depictions move in different, opposing directions when the security element is tilted.

18. The security element according to claim 6, wherein the reflection-increasing coating or the reflective ink layer has a color-shift effect.

19. The security element according to claim 1, wherein the planar facets are embossed in a reflective ink layer.

20. The security element according to claim 1, wherein the security element is a security thread, a tear strip, a security band, a security strip, a patch or a label for application to a security paper or a value document.

21. A method for manufacturing an optically variable security element according to claim 1, in which a desired target curve and a desired movement behavior of the target curve when the security element is tilted about two different axes are defined, a depiction region for the target curve is determined in which, when the security element is tilted, the target curve moves away from a center position in accordance with the defined movement behavior, in an areal motif region in the determined depiction region, a plurality of reflective, planar facets having an inclination slope against the plane of the areal motif region are arranged and aligned in such a way that they have, as inclination components, a parallel component parallel to the target curve in the center position, and a normal component perpendicular to the target curve in the center position, wherein a direction of a vector defining each inclination component indicates the respective direction of rising facet level and an absolute value of the vector defining each inclination component indicates the slope in the respective direction, such that the inclination components together yield the total slope N of the planar facet;

for the planar facets in the depiction region, a first of the two inclination components being chosen dependent on the distance of the respective facet from the target curve, and a second of the two inclination components being chosen in a predetermined spreading angle range independently of the distance of the respective facet from the target curve, wherein the second inclination component of the planar facets varies irregularly in the spreading angle range.

* * * * *